US005224360A

United States Patent [19]

Kawase et al.

[11] Patent Number: 5,224,360

[45] Date of Patent: Jul. 6, 1993

[54] CIRCULAR KNITTING MACHINE HAVING REMOVABLE CYLINDER

[75] Inventors: Shinji Kawase; Toshiyuki Tanaka, both of Hyogo, Japan

[73] Assignee: Precision Fukuhara Works, Ltd., Japan

[21] Appl. No.: 971,411

[22] Filed: Nov. 4, 1992

Related U.S. Application Data

[63] Continuation-in-part of Ser. No. 924,852, Aug. 4, 1992, abandoned, which is a continuation-in-part of Ser. No. 859,282, Mar. 26, 1992, abandoned, which is a continuation of Ser. No. 625,029, Dec. 10, 1990, abandoned.

[30] Foreign Application Priority Data

Nov. 12, 1989 [JP] Japan ..... 1-322257

[51] Int. Cl.[5] ..... D04B 9/00; D04B 15/00

[52] U.S. Cl. ..... 66/19; 66/8; 66/1 R

[58] Field of Search ..... 66/1 R, 8, 19; 29/426.1, 426.5

[56] References Cited

FOREIGN PATENT DOCUMENTS

| | | | |
|---|---|---|---|
| 126911 | 3/1948 | Australia | 66/8 |
| 3706750 | 9/1988 | Fed. Rep. of Germany | 66/1 R |
| 1578661 | 11/1980 | United Kingdom | 66/8 |

*Primary Examiner*—Clifford D. Crowder
*Assistant Examiner*—John J. Calvert
*Attorney, Agent, or Firm*—Bell, Seltzer, Park & Gibson

[57] ABSTRACT

A vertical shaft of the machine is encircled by a vertically movable sleeve that supports, at its lower end, a dial cam holder having a stepped portion. A needle dial 17 bolted to the undersurface of the sleeve has a recess that closely receives the stepped portion of the sleeve. Vertical movement is imparted to the sleeve and shaft by a gear that encircles the sleeve and has screw threads mating with screw threads upon the upper end section of the sleeve. Such movement provides vertical clearance that facilitates lateral removal and insertion of the needle cylinder into/from the machine. The needle cylinder is releasably secured to the machine's ring gear by plate members that are releasably center.

10 Claims, 3 Drawing Sheets

CIRCULAR KNITTING MACHINE HAVING REMOVABLE CYLINDER

CROSS-REFERENCE TO RELATED APPLICATIONS

This application is a continuation-in-part of pending application Ser. No. 07/924,852, filed 4 Aug. 1992, now abandoned which is a continuation-in-part of pending application Ser. No. 07/859,282, filed 26 Mar. 1992, now abandoned which is a continuation of application Ser. No. 7/625,029, filed 10 Dec. 1990, now abandoned.

FIELD OF THE INVENTION

This invention relates to circular knitting machines and in particular to a double knit circular knitting machine having a dial which can be lifted so as to facilitate removal and replacement of the needle cylinder and needle dial.

BACKGROUND OF THE INVENTION

In commonly assigned application Ser. No. 07/561,341, filed 31 Jul. 1990, now U.S. Pat. No. 5,099,661 a double knit circular knitting machine is disclosed which is constructed to facilitate more ready replacement of the needle cylinder and sinker dial without the necessity of hoisting the dial by a chain block and the like. The knitting machine includes a circular dial supported adjacent the opening in the upper end of the needle cylinder. A rotatable support shaft is supported at the upper end of a frame support member and extends downwardly to a position adjacent the circular opening in the upper end of the needle cylinder. A vertically extending support sleeve surrounds the support shaft and is supported at the upper end on a frame support member for telescopic vertical movement relative to the support shaft. The lower end of the support sleeve is fixed to the dial for supporting same. A dial control for lifting and lowering the support sleeve along the support shaft is operable to lift the dial a sufficient distance to permit removal and replacement of the needle cylinder.

It has been found desirable to mount the dial so that it and the needle cylinder can be more easily removed. Additionally, after removal and replacement of component parts, the dial must be set to exact specifications. Thus, the dial should not only be more easily removed, but should also be capable of being easily returned to an exact position.

SUMMARY OF THE INVENTION

It is therefore an object of this invention to provide a circular knitting machine which is constructed to facilitate more ready removal and replacement of the needle cylinder and wherein the needle dial can be replaced and reset more exactly.

These and other objects and advantages of the present invention are accomplished by a circular knitting machine which is constructed so as to facilitate removal and ready replacement of the needle cylinder and dial with more exact replacement and resetting of the dial.

The knitting machine includes a frame, and an annular ring gear mounted for rotation upon the frame. Plates connected to the ring gear supportively underlie the needle cylinder and are releasably connected, as by means of bolts, to the cylinder and to the ring gear. A vertically movable hollow support shaft extending downwardly from the upper part of the knitting machine is encircled by a rotatable, axially fixed inner support sleeve that is in turn encircled by a stationary outer support sleeve. A gear encircling the upper end portion of the inner support sleeve has, upon its inner surface, screw threads that mesh with mating screw threads upon the outer surface of the inner support sleeve. Rotation of the gear imparts vertical movement to the inner support sleeve and the support shaft and the components carried by it. Such components include a dial cam holder that is supported by a stepped portion of the support sleeve, and a needle dial that is releasably connected by bolts to the undersurface of the stepped portion of the support sleeve and that has a central opening which closely receives the stepped portion of the support sleeve and that has a surface substantially flush with an upper surface of the dial cam holder. The close fit between the foregoing components facilitates accurate positioning of the needle dial.

BRIEF DESCRIPTION OF THE DRAWINGS

Some of the objects and advantages of the present invention having been stated, others will be more fully understood from the detailed description which follows and by reference to the accompanying drawings in which.

DESCRIPTION OF THE PREFERRED EMBODIMENT

Figure 1:
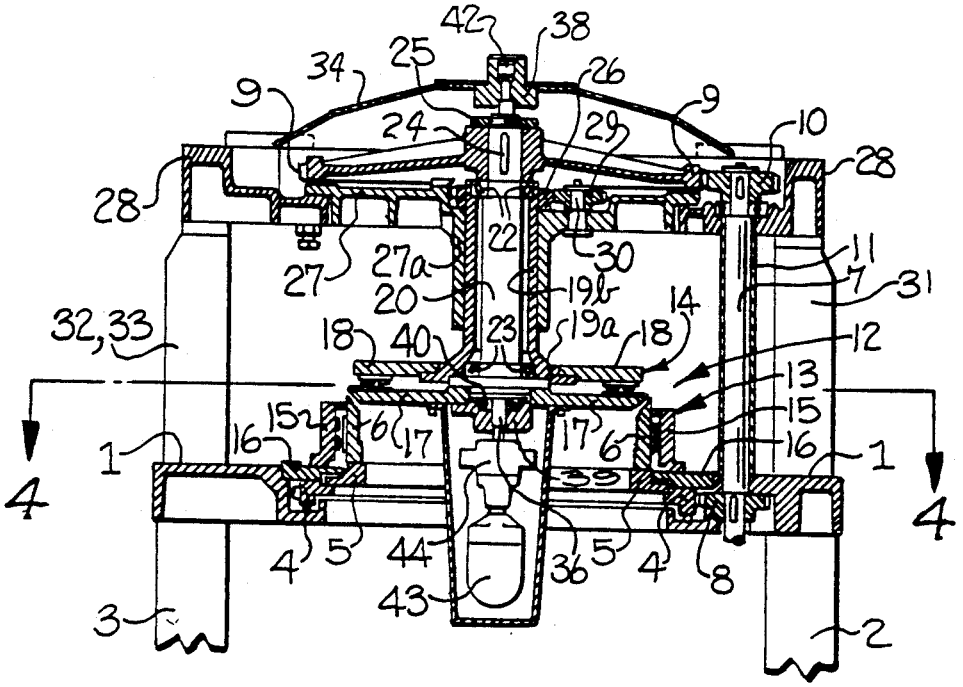
FIG. 1 is a partially schematic vertical sectional view of the upper portion of a knitting machine in accordance with the present invention.
Figure 2:
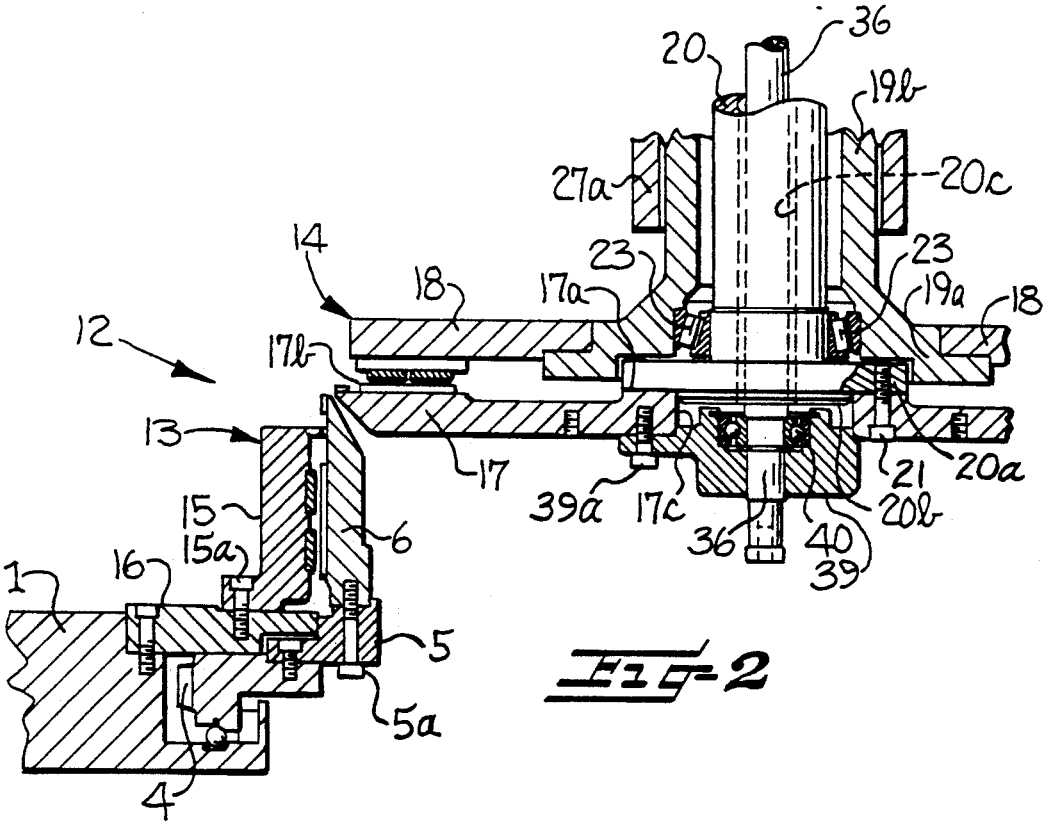
FIG. 2 is an enlarged fragmentary sectional view of component members of the needle cylinder, needle dial and thereto adjacent components of the knitting machine.

Referring now to the drawings, and more particularly to FIG. 1, there is illustrated a double knit circular knitting machine in accordance with a preferred embodiment of the present invention. The machine includes frame members 27, 28 and a bed 1 that are supported by three equally spaced support legs 2 and 3, only two of which are illustrated. The machine further includes a knitting unit, broadly indicated at 12 and including a needle cylinder 6, that operates to knit tubular fabric which typically is wound flattened onto a roll or other take-up apparatus (not shown) positioned below unit 12.

A large annular driven gear 4, which may be and preferably is of sectional construction, is mounted upon and rotatable relative to bed 1. Needle cylinder 6 is releasably secured upon the upper side of gear 4 by plate means, illustratively and preferably consisting of a plurality of inwardly extending plates 5 (only one of which is shown in the drawings) and bolts 5*a*. Gear 4 meshes with a driving gear 8 on the knitting machine drive shaft 7. A conventional power source (not shown) conventionally positioned in the knitting machine provides the force for rotating drive shaft 7. A second driven gear 10 at the top of drive shaft 7 meshes with a large annular gear 9 that is connected by a key 24 to a hollow support shaft 20 and that overlies frame members 27, 28. The drive shaft 7 is covered with a cylindrical protective member 11 for protection of the shaft against contaminants and other harmful material.

The knitting unit 12 includes a cylinder needle area 13, dial needle area 14, and the usual yarn carriers (not shown). The cylinder needle area 13 includes a plurality of needle groves formed in the outer periphery of needle cylinder 6. Cylinder needles (not shown) are mounted for vertical sliding movement along the needle grooves. Needle activating cams mounted on the inner surface of a cam holder 15 control movement of the needles of cylinder 6 during knitting. The cam holder 15 is releasably secured to the upper part of a circular cam ring 16 which is fixed to the bed plate 1 by additional bolts 5*a*.

The dial needle area 14 includes a dial 17 and a dial cam holder 18. Dial 17 has grooves within which dial needles (not shown) are mounted for radial sliding movement. Dial needle activating cams supported on the lower surface of dial cam holder 18 control movement of the dial needles. The needle cylinder 6 and dial 17 are rotated at the same speed. Dial 17 is releasably secured by bolts 21 to the planar underside surface of a diametrically enlarged portion 20*a* of hollow support shaft 20. The dial 17 includes a shaft engaging upper surface 17*a* which engages the stepped lower end portion 20*b* of the support shaft 20, and a dial cam holder engaging surface 17*b*. The surface 17*a* of the needle dial 17 which engages the lower portion of the support shaft 20 is substantially coplanar with the dial cam holder engaging surface 17*b*. Portion 20*b* of support Shaft 20 extends into opening 17c of needle dial 17, the diameter of which is approximately equal to that of the diametrically small stepped portion 20*b* of support shaft 20. The vertical dimension of the small stepped portion 20*b* of support shaft 20 is about 10 mm.

Figure 5:
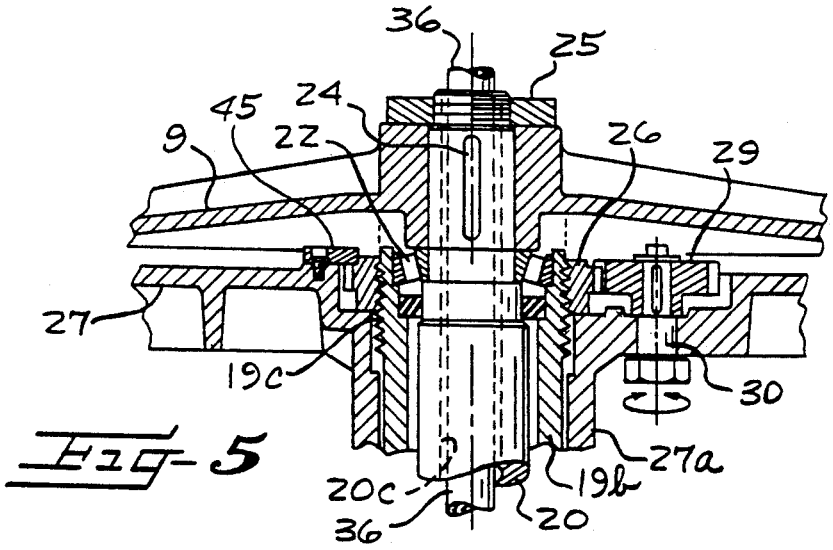
FIG. 5 is an enlarged fragmentary elevational view of the upper section of the support sleeve shown in FIG. 1, and of adjacent components for supporting and at desired times imparting vertical movement to the sleeve.
Figure 6:
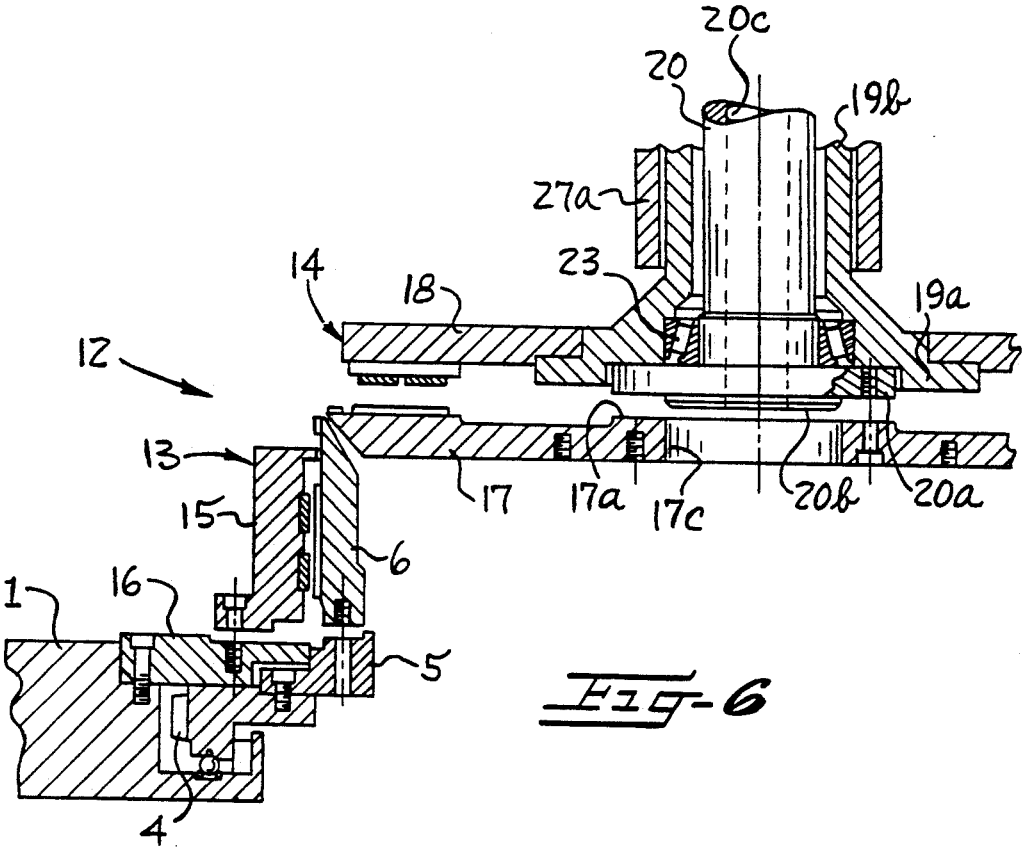
FIG. 6 is a partially exploded perspective view of components shown in FIG. 2.

Shaft 20 is encircled by inner and outer sleeves 19*b*, 27*a*, respectively; bearings 22, 23; and by a gear 26 having upon its inner surface screw threads that mate with screw threads upon the outer surface of the upper end section of inner sleeve 19*b*. Gear 26 is driven at desired times by a gear 29 that is keyed to a shaft 30 mounted upon frame member 27. Shaft 30 may be rotated by a wrench (not shown) applied to the shaft's headed lower end. A retainer 45 (FIG. 5) connected to frame member 27 and overlying gear 26 prevents vertical movement of the gear. Rotative movement of gear 26 therefore imparts limited vertical movement to sleeve 29*b*, which in turn imparts vertical movement to shaft 20 and to the components connected to the shaft's lower end.

Figure 3:
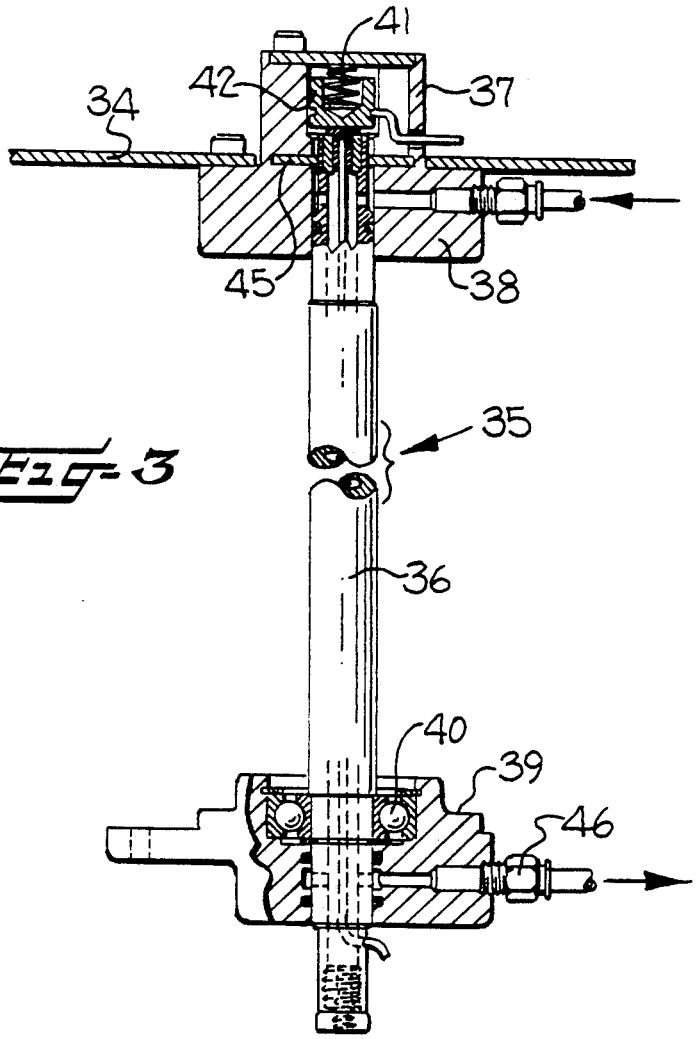
FIG. 3 is an enlarged partially schematic sectional view of pneumatic air control means and adjacent components associated with a support shaft of the knitting machine.
Figure 4:
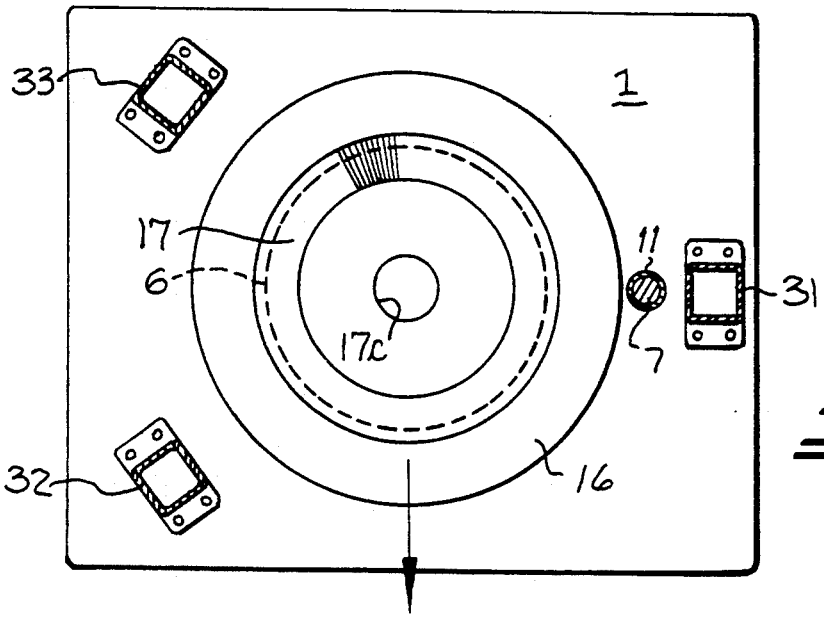
FIG. 4 is a horizontal sectional view taken along the line 4—4 of FIG. 1 and showing in top plan the direction of removal of the needle cylinder and dial laterally from the knitting machine.

An assembly 35 for conducting compressed air and electrical wiring through shaft 20 includes a hollow shaft 36 that extends through shaft 20, and also includes housings 37, 39 respectively connected to the upper and lower end portions of shaft 36. Housing 37 contains electromechanical components 41, 42 that control the introduction of compressed air into the housing from a compressed air source (not shown). Lower housing 39 contains a support bearing 40 and a fitting 46 for discharging the compressed air into shaft 20. The compressed air passing from the lower end portion of shaft 36 during operation of the knitting machine removes lint from dial 17. Grooves 20*c* (FIG. 5) may be provided in shaft 20 to facilitate passage of air through the shaft. Shaft 36 is supported at its upper end by a bearing 38 connected to cover 34. The shaft is supported at its lower end by bearing 40 of housing 39. As shown in FIG. 1, a lamp 43 and transformer 44 underlie the lower portion of vertical shaft 36. The transformer 44 is fixed to shaft 36. As the shaft 20 rotates, the bearing housing 39 rotates about shaft 36, which is held stationary by a locknut 45 (FIG. 3). Preparatory to removal of needle cylinder 6, the following components are removed from machine 10: transformer 44; lamp 43; the housing surrounding the transformer and lamp: the air introducing assembly; cam holder 15; and the bolts securing needle cylinder 6 to plates 5. Following removal of the foregoing components, and removal of the bolts connecting dial 17 to shaft 20, and the bolts connecting needle cylinder 6 to gear 4, the needle cylinder and dial may be removed laterally and as a unit from the knitting machine. The general direction of removal of the needle cylinder is indicated by the arrow in FIG. 4.

Subsequent replacement of the same needle cylinder and dial, or other ones, can be effected in the same manner with equal facility and precision by reversing the foregoing procedures.

While a specific embodiment of the invention has been shown and described, this was for purposes of illustration only, and not for purposes of limitation, the scope of the invention being in accordance with the following claims.

We claim:

1. A knitting machine, comprising:

a frame;

a needle cylinder;

releasable means releasably mounting said needle cylinder upon said frame for rotative movement during operation of said machine relative to said frame, and for lateral removal from and insertion into said knitting machine at desired times;

a generally vertical support shaft carried by said frame;

said support shaft having at a lower end thereof circular stepped portion adjacent said needle cylinder;

a needle dial releasably secured to said stepped portion of said support shaft and having an opening closely receiving said stepped portion of said support shaft;

a support sleeve encircling said support shaft;

a dial cam holder carried by said support sleeve;

and drive means for moving said support sleeve, said dial cam holder, and dial cam vertically so as to provide vertical clearance between said dial cam and said needle cylinder, said vertical clearance facilitating lateral movement of said needle cylinder into and from said knitting machine.

2. A knitting machine as in claim 1, wherein said drive means for moving said support sleeve includes a rotatable gear encircling said support sleeve, and mating screw threads upon said support sleeve and said gear.

3. A knitting machine as in claim 2, wherein said drive means includes a second gear meshing with said rotatable gear for imparting rotation to said rotatable gear.

4. A knitting machine as in claim 3, and further including a retainer for preventing vertical movement of said rotatable gear.

5. A knitting machine as in claim 1, wherein said needle dial has an upwardly facing and centrally disposed abutment surface substantially coplanar with a downwardly facing surface of said needle dial when said needle dial is securely mounted to said support shaft.

6. A knitting machine as in claim 1, wherein said releasable means releasably mounting said needle cylinder upon said frame includes a ring gear mounted on said frame, and plate means connected to and projecting inwardly from said ring gear toward the center thereof.

7. A knitting machine as in claim 6, wherein said plate means includes at least one plate member releasably connected to said ring gear.

8. A knitting machine as in claim 6, wherein said needle cylinder rests on and extends upwardly from said plate means.

9. A knitting machine as in claim 8, and further including bolt means releasably interconnecting said ring gear and said plate means.

10. A knitting machine as in claim 1 and further including air conducting means extending through said support shaft for conducting lint-removing compressed a downwardly through and from said support shaft.

* * * * *

UNITED STATES PATENT AND TRADEMARK OFFICE

CERTIFICATE OF CORRECTION

PATENT NO. : 5,224,360

DATED : July 6, 1993

INVENTOR(S) : Kawase et al.

It is certified that error appears in the above-identified patent and that said Letters Patent is hereby corrected as shown below:

In the Abstract, last line, after "releasably" insert -- connected to the ring gear and that extend toward its --.

Column 3, line 40, "Shaft" should be -- shaft --.

Column 6, line 13, "a" should be -- air --.

Signed and Sealed this

Twenty-second Day of February, 1994

*Attest:*

BRUCE LEHMAN

*Attesting Officer*

*Commissioner of Patents and Trademarks*